US005361192A

United States Patent [19]

Lai

[11] Patent Number: 5,361,192

[45] Date of Patent: Nov. 1, 1994

[54] DECORATIVE LAMP SHADE AND CHRISTMAS LAMP ASSEMBLY

[76] Inventor: Chi-Shih Lai, 8F-6, No. 100, Sec. 2, Hoping E. Rd., Taipei, Taiwan, Prov. of China

[21] Appl. No.: 166,633

[22] Filed: Dec. 15, 1993

[51] Int. Cl.[5] ..... H01R 33/00

[52] U.S. Cl. ..... 362/123; 362/249; 362/237; 362/806; 362/368; 362/457; 362/226; 439/452

[58] Field of Search ..... 362/123, 806, 396, 249, 362/391, 355, 368, 363, 237, 448; 439/699, 611, 619, 419, 452, 453, 463, 470

[56] References Cited

U.S. PATENT DOCUMENTS

| | | | |
|---|---|---|---|
| 3,275,818 | 9/1966 | Campbell | 362/249 |
| 3,660,801 | 5/1972 | Paulfus | 439/419 |
| 4,679,126 | 7/1987 | Van Sickler | 362/237 X |
| 5,012,397 | 4/1991 | Tseng | 362/237 |
| 5,021,935 | 6/1991 | Gary | 362/249 X |
| 5,278,741 | 1/1994 | Ehrman | 362/249 X |

*Primary Examiner*—Ira S. Lazarus
*Assistant Examiner*—Thomas M. Sember
*Attorney, Agent, or Firm*—Browdy and Neimark

[57] ABSTRACT

A decorative lamp shade and Christmas lamp assembly includes a Christmas lamp, a spherical glass lamp shade placed round the Christmas lamp and having a top open neck, a cylindrical mounting socket mounted around the top open neck of the lamp shade and having hooks for hanging on a Christmas tree, a lamp holder having a top ring hung on the electric wires of the Christmas lamp by hooks thereof and a plurality of vertical bottom plates extended downward from the top ring and equally spaced around the center hole thereof and respectively stopped against the inside surface of the lamp shade to hold the mounting socket and the lamp shade together.

3 Claims, 5 Drawing Sheets

DECORATIVE LAMP SHADE AND CHRISTMAS LAMP ASSEMBLY

BACKGROUND OF THE INVENTION

The present invention relates to a decorative lamp shade and Christmas lamp assembly which is easy to assemble without the use of any external fastening devices, and which has mounting hooks for hanging on a Christmas tree.

A variety of Christmas lamp sets and decorative strings are known and available on the market. There is a Christmas lamp set having decorative, spherical glass lamp shades respectively fastened to and place round the lamps thereof to make them beautiful. However, the installation of these decorative, spherical glass lamp shades is not easy. Further, because the lamp shades are fastened to the lamps by an adhesive glue, the lamp shades cannot be conveniently removed from the lamps when installed for a replacement. If any lamp shade is damaged, the lamp shade as well as the respective lamp socket must be replaced.

SUMMARY OF THE INVENTION

The present invention eliminates the aforesaid problems. It is therefore an object of the present invention to provide a decorative lamp shade and Christmas lamp assembly which is easy to assemble and can be conveniently dismantled for a replacement. It is another object of the present invention to provide a decorative lamp shade and Christmas lamp assembly which is inexpensive to manufacture. It is still another object of the present invention to provide a decorative lamp shade and Christmas lamp assembly which can be hung on a Christmas tree.

According to one aspect of the present invention, the decorative lamp shade and Christmas lamp assembly comprises a Christmas lamp, a spherical glass lamp shade placed round the Christmas lamp and having a top open neck, a cylindrical mounting socket mounted around the top open neck of the lamp shade and having hooks for hanging on a Christmas tree, a lamp holder having a top ring hung on the electric wires of the Christmas lamp by hooks thereof and a plurality of vertical bottom plates extended downward from the top ring and equally spaced around the center hole thereof and respectively stopped against the inside surface of the lamp shade to hold the mounting socket and the lamp shade together. According to another aspect of the present invention, the mounting socket comprises two symmetrical hooks at two opposite sides for hanging on a Christmas tree.

DETAILED DESCRIPTION OF THE PREFERRED EMBODIMENT

Figure 1:
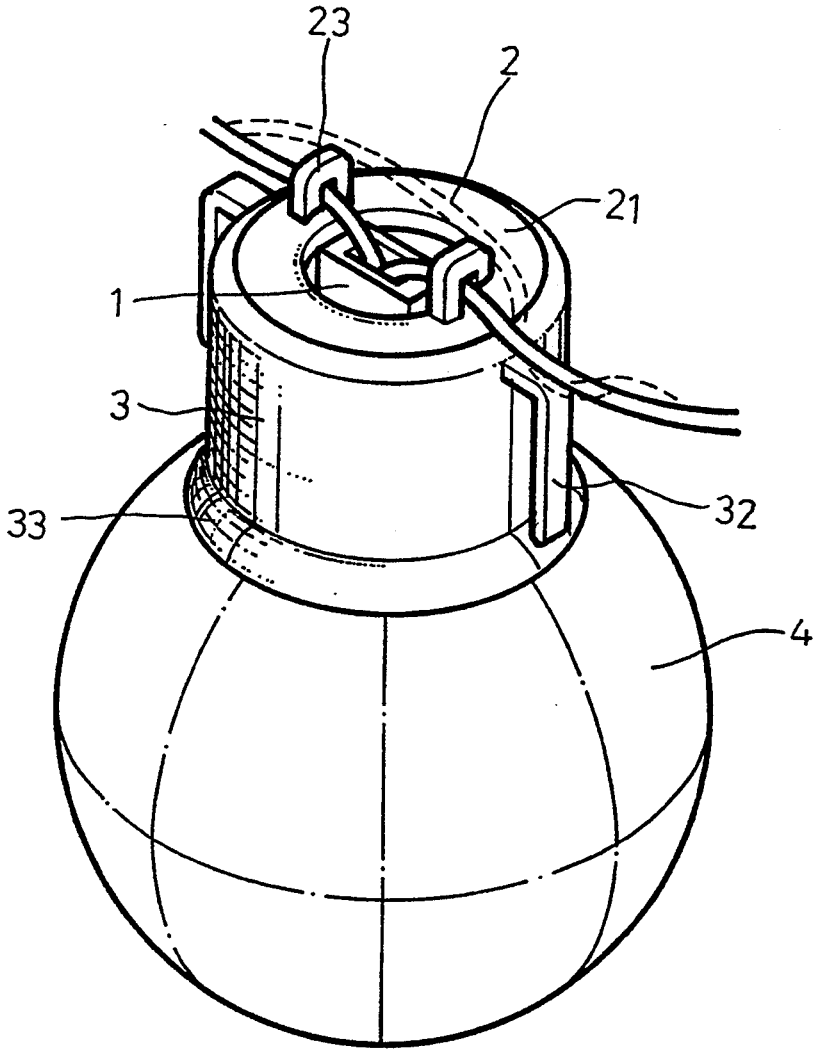
FIG. 1 is an elevational view of a decorative lamp shade and Christmas lamp assembly according to the preferred embodiment of the present invention.
Figure 2:
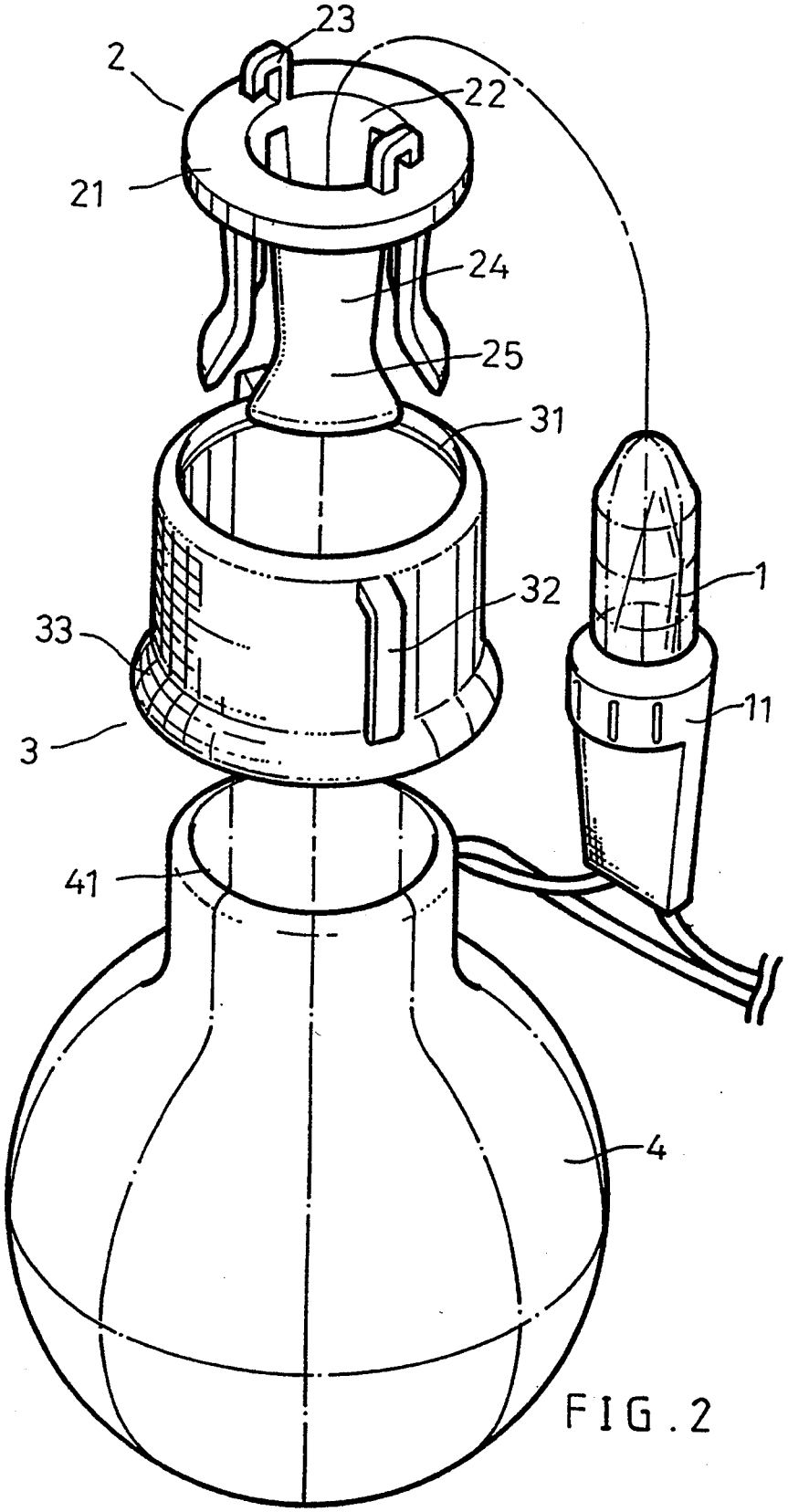
FIG. 2 is an exploded view of the decorative lamp shade and Christmas lamp assembly shown in FIG. 1.

Referring to FIGS. 1 and 2, a decorative lamp shade and Christmas lamp assembly in accordance with the preferred embodiment of the present invention is generally comprised of a Christmas lamp 1, a lamp holder 2 to hold the Christmas lamp 1, a shade 4 connected to the lamp holder 2 and placed round the Christmas lamp 1, and a mounting socket 3 fastened to the lamp holder 2 to hold down the shade 4.

The Christmas lamp 1 comprises a lamp socket 11 connected to the electric circuit of a Christmas light set. The lamp holder 2 comprises a top ring 21 defining a circular center hole 22, two hooks 23 raised from the top ring 21 at two opposite sides, a plurality of vertical bottom plates 24 extended downward from the top ring 21 and equally spaced around the circular center hole 22. Each vertical bottom plate 24 has a respective bottom end 25 made gradually bigger toward the bottom and curved outward. The mounting socket 3 is made of cylindrical shape comprising an inside annular groove 31 around the inside wall thereof at the top, an outward bottom flange 33 around the border thereof at the bottom fitting over the shade 4, and two mounting hooks 32 extended from the outside wall thereof at two opposite sides. The shade 4 is made from glass of spherical shape, having an open neck 41 at one end fitted into the mounting socket 3 from the bottom.

Figure 3:
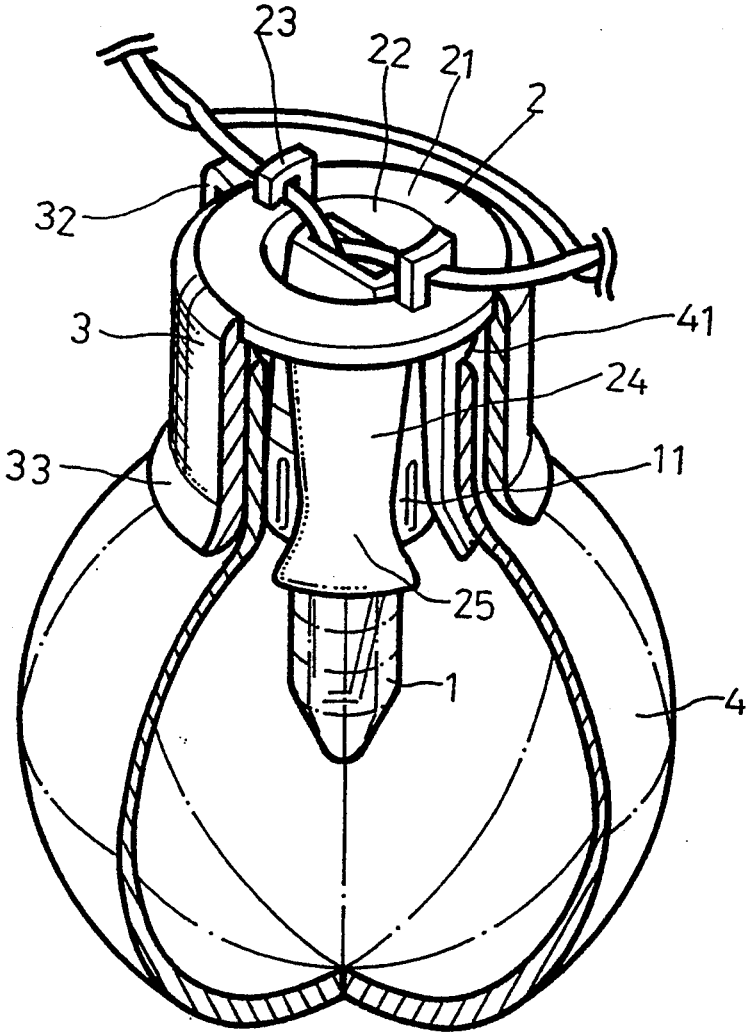
FIG. 3 is a cutaway of the decorative lamp shade and Christmas lamp assembly shown in FIG. 1.

Referring to FIGS. 2 and 3, the mounting socket 3 is mounted around the open neck 41 of the shade 4, then the lamp holder 2 is inserted into open neck 41 of the shade 4 with the top ring 21 engaged into the inside annular groove 31 of the mounting socket 3 permitting the vertical bottom plates 24 to stop against the inside wall of the shade 4. Therefore, the lamp holder 2, the mounting socket 3, and the shade 4 are fastened together. Then, the lamp socket 11 of the Christmas lamp 1 is invertedly inserted into the circular center hole 22 of the lamp holder, for permitting the hooks 23 to hook on the the hot and neutral wires of the Christmas lamp 1 respectively. Therefore, the lamp holder 2 is hung on the Christmas light set.

Figure 4:
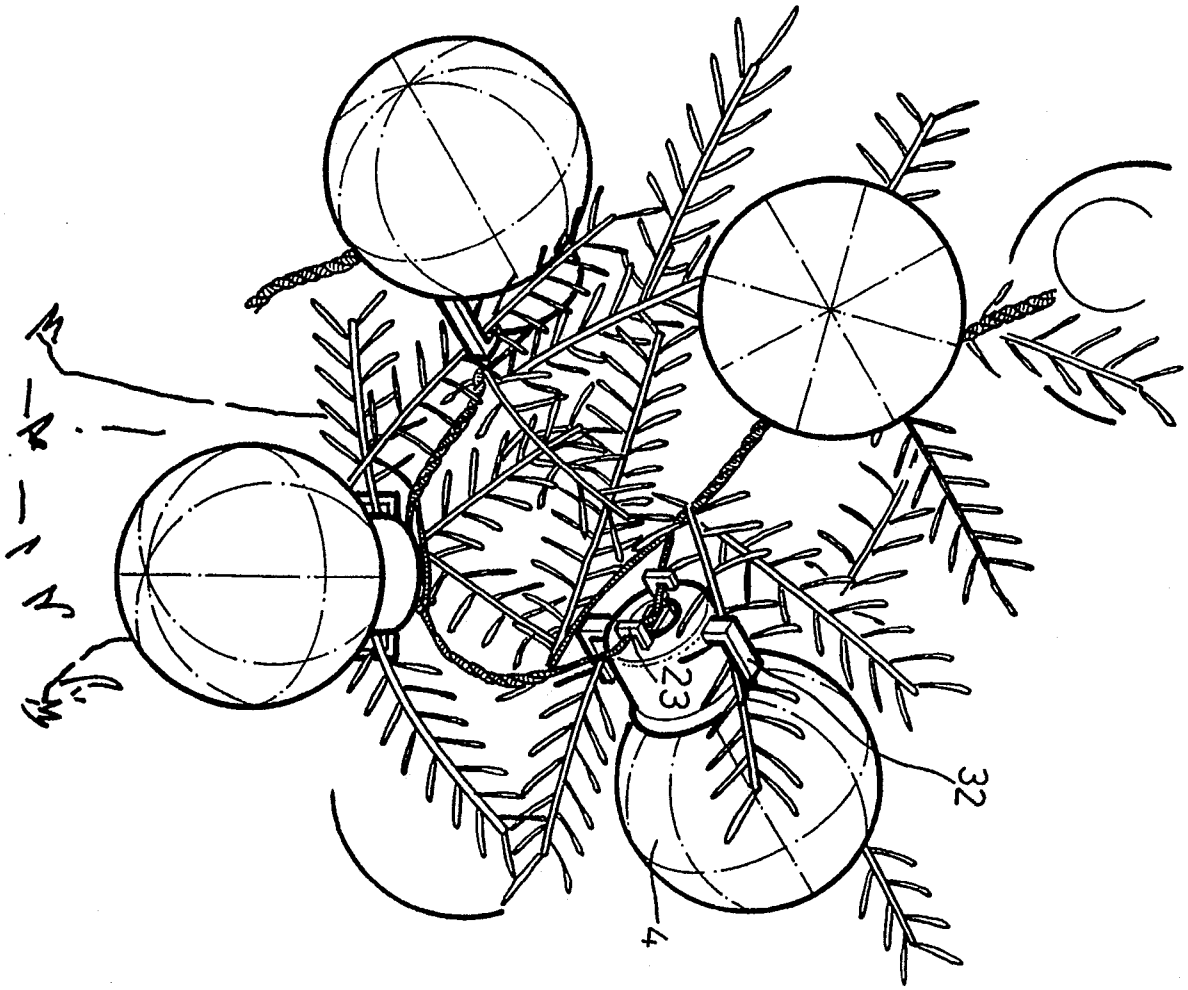
FIG. 4 is an applied view of the present invention.

Referring to FIG. 4, by means of the mounting hooks 32 of the mounting socket 3, the decorative lamp shade and Christmas lamp assembly can be hung on a branch of a Christmas tree.

Figure 5:
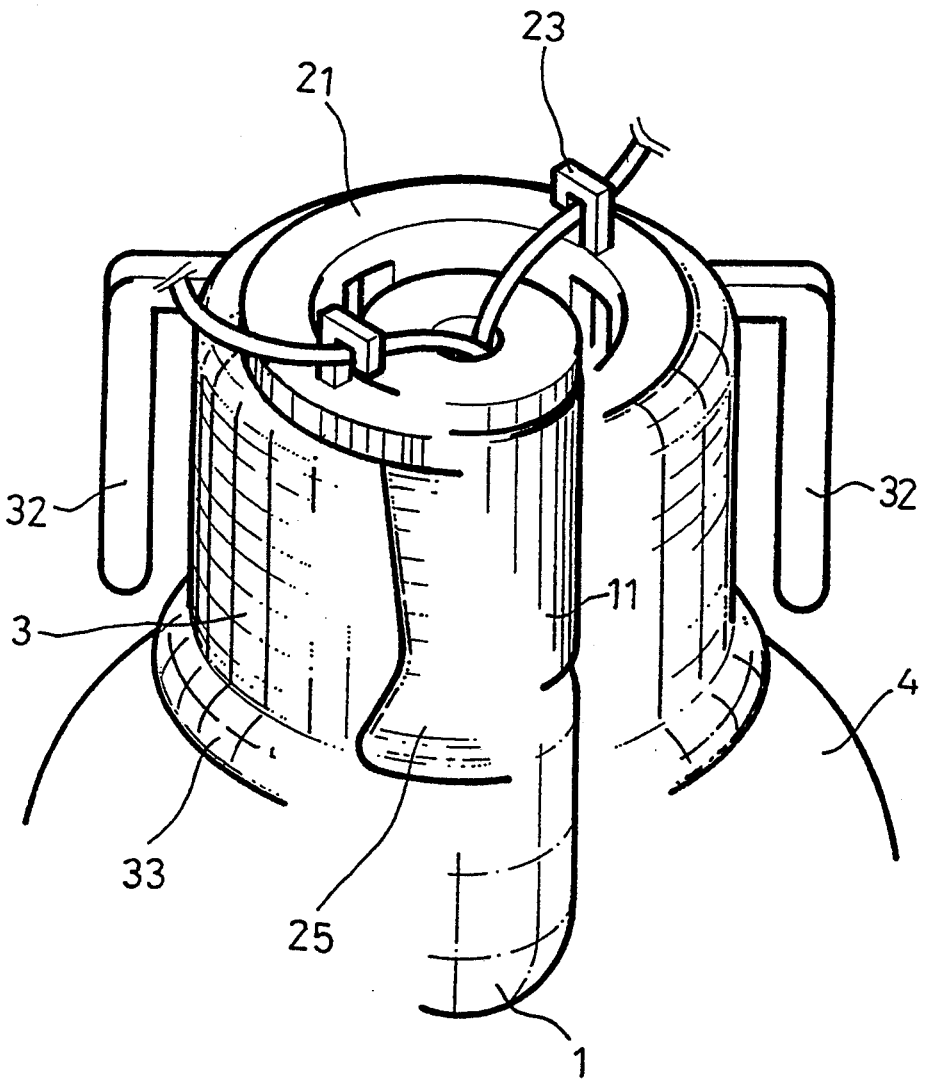
FIG. 5 shows an alternate form of the lamp socket of the Christmas lamp suspended from the lamp holder inside the mounting socket and the lamp shade.

Referring to FIG. 5, therein illustrated is an alternate form of the Christmas lamp 1. The lamp socket 11 of the Christmas lamp 1 according to this alternate form is made of cylindrical shape.

While only few embodiments of the present invention have been shown and described, it will be understood that various modifications could be made without departing from the spirit of the invention.

What is claimed is:

1. A decorative lamp shade and Christmas lamp assembly, comprising:

a Christmas lamp having electric wires connected to an electric circuit of a Christmas light set;

a mounting socket made of cylindrical shape having an inside annular groove around a top opening thereof and an outward bottom flange around a bottom opening thereof;

a lamp shade made from glass of spherical shape and placed around said Christmas lamp, said lamp shade having an open neck at one end fitted into said bottom opening of said mounting socket; and a lamp holder received inside said mounting socket to hold said lamp shade and said mounting socket together, said lamp holder comprising a top ring received within said mounting socket and engaged into said inside annular groove and defining a circular center hole, two hooks raised from said top ring at the top at two opposite locations and respectively hung on the electric wires of said Christmas lamp, a plurality of vertical bottom plates extended downward from said top ring and equally spaced around said circular center hole and respectively stopped against the inside surface of said lamp shade to hold said mounting socket and said lamp shade together.

2. The decorative lamp shade and Christmas lamp assembly of claim 1 wherein said mounting socket comprises two hooks on the outside for hanging on a Christmas tree.

3. The decorative lamp shade and Christmas lamp assembly of claim 1 wherein each vertical bottom plate of said lamp holder has a bottom end made gradually bigger toward the bottom and fitting over the inside surface of said shade.

* * * * *